US009322252B2

(12) United States Patent
Head

(10) Patent No.: US 9,322,252 B2
(45) Date of Patent: Apr. 26, 2016

(54) FIXED WET CONNECTION SYSTEM FOR AN ELECTRICAL SUBMERSIBLE PUMP

(71) Applicant: ACCESSESP UK LIMITED, Staines (GB)

(72) Inventor: Philip Head, Staines (GB)

(73) Assignee: ACCESSESP UK LIMITED (GB)

( * ) Notice: Subject to any disclaimer, the term of this patent is extended or adjusted under 35 U.S.C. 154(b) by 120 days.

(21) Appl. No.: 13/936,272

(22) Filed: Jul. 8, 2013

(65) Prior Publication Data

US 2014/0020907 A1 Jan. 23, 2014

(30) Foreign Application Priority Data

Jul. 17, 2012 (GB) ..... 1212694.2

(51) Int. Cl.
*E21B 43/12* (2006.01)
*E21B 33/038* (2006.01)

(52) U.S. Cl.
CPC ..... *E21B 43/128* (2013.01); *E21B 33/0385* (2013.01)

(58) Field of Classification Search
USPC ..... 166/377, 381, 66.4
See application file for complete search history.

(56) References Cited

U.S. PATENT DOCUMENTS

2010/0206577 A1* 8/2010 Martinez ..... 166/369
2011/0030972 A1* 2/2011 Brookbank ..... 166/381

FOREIGN PATENT DOCUMENTS

GB 2403490 A 1/2005
GB 2478108 A 8/2011

OTHER PUBLICATIONS

British Search Report, Application No. GB1212694.2, Examiner Dr. Michael Gooch, Dated Sep. 27, 2012.

* cited by examiner

*Primary Examiner* — David Andrews
*Assistant Examiner* — Ronald Runyan
(74) *Attorney, Agent, or Firm* — Gordon G. Waggett, P.C.

(57) ABSTRACT

A wet connection system comprises a fixed tubing with an orientation profile and redundant, first and second fixed wet connectors, and an electrical submersible pump assembly (ESP) comprising a wet connector and an orientation element for engaging the orientation profile. The ESP can be reconfigured, for example, by interchanging its component modules so as to change the position of its wet connector with respect to the orientation element, whereby the wet connector on the ESP can be engaged alternatively with either one of the fixed wet connectors when the orientation element is engaged with the orientation profile in the same deployed position of the ESP.

10 Claims, 4 Drawing Sheets

FIXED WET CONNECTION SYSTEM FOR AN ELECTRICAL SUBMERSIBLE PUMP

CROSS-REFERENCE TO RELATED APPLICATION

This application claims priority to and the benefit of Great Britain Patent Application No. GB 1212694.2, filed Jul. 17, 2012, the entirety of which is hereby incorporated by reference as if fully set forth herein.

This invention relates to fixed power supply systems in wells, particularly hydrocarbon wells, whereby an electrical submersible pump assembly (ESP) may be lowered to a deployed position and then connected to the power supply via a wet connection, i.e. an electrical connection which can be made and unmade in the fluid environment of the well.

It is desirable for the central bore of the production tubing installed in a hydrocarbon well to be clear of power cabling so as to provide an unobstructed flowpath which can also be used for the introduction of tooling into the well. Therefore it is often preferred to install a fixed power supply comprising cabling which is fixed to tubing (such as the production tubing or well casing), for example, by clamping to the external surface of the tubing, and terminating at a wet connector via which the ESP may be remotely connected to the power supply.

GB2403490 discloses one system of this type, comprising fixed cabling terminating in one or (for three-phase power) an array of three wet connectors which are radially moveable into the central bore of the production tubing. The ESP has a corresponding array of wet connectors and engages an orientation profile inside the production tubing to rotate it to the correct position in which the respective connectors engage together to connect the ESP to each respective conductor of the power supply. In other systems the ESP comprises a radially outwardly moveable connector which engages a fixed connector on the tubing.

Fixed cabling is generally reliable, with most failures occurring in the ESP which can be readily recovered and redeployed. However, if the fixed cabling or wet connector does fail then it cannot be repaired without recovering to surface the tubing to which it is fixed, so systems of this type are critically dependent on the integrity of the fixed components.

It is the object of the present invention to reduce this vulnerability.

In accordance with the present invention there are provided a method and an apparatus as defined in the claims.

An illustrative embodiment will now be described, purely by way of example and without limitation to the scope of the claims, and with reference to the accompanying drawings, in which:

Corresponding reference numerals indicate corresponding parts in each of the figures.

Figure 1A:
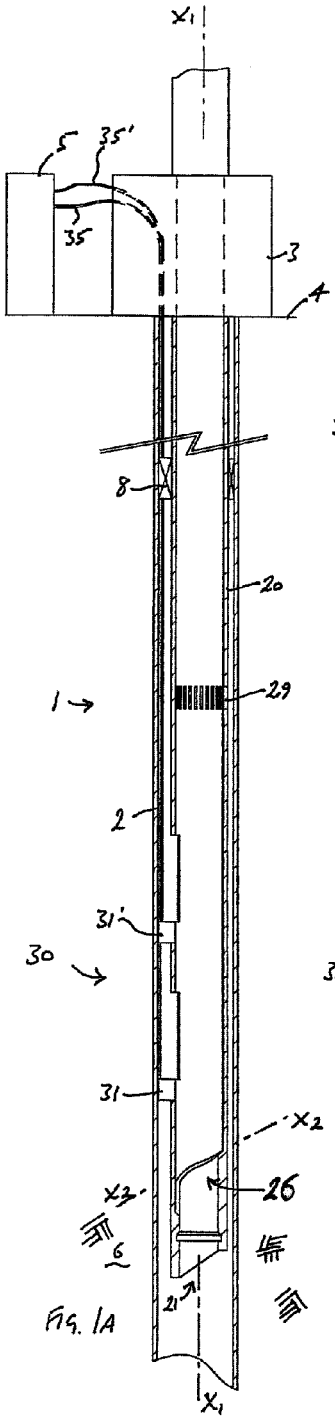
FIG. 1A shows in longitudinal section a well adapted for the deployment of an ESP.
Figure 1B:
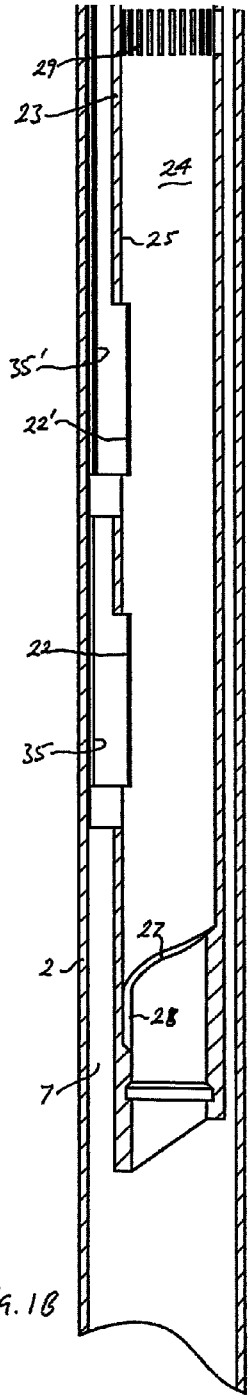
FIG. 1B is an enlarged view of part of FIG. 1A.

Referring to FIGS. 1A and 1B, a well 1 comprises a borehole lined with a casing 2 connected to a wellhead 3 at the ground surface 4. A power supply 5 is provided at the wellhead. Production tubing 20 extends down inside the casing from the wellhead to terminate at its open lower end 21 in the region of the productive formation 6, with the annulus (annular gap) 7 between the production tubing and the casing being sealed by a packer 8. Perforations 29 in the tubular wall 23 of the production tubing connect its internal bore 24 with the annulus 7 below the packer 8. For simplicity, only single strings of casing and production tubing are shown, although in practice there may be several strings with successively smaller diameters connected end to end.

Figure 2:
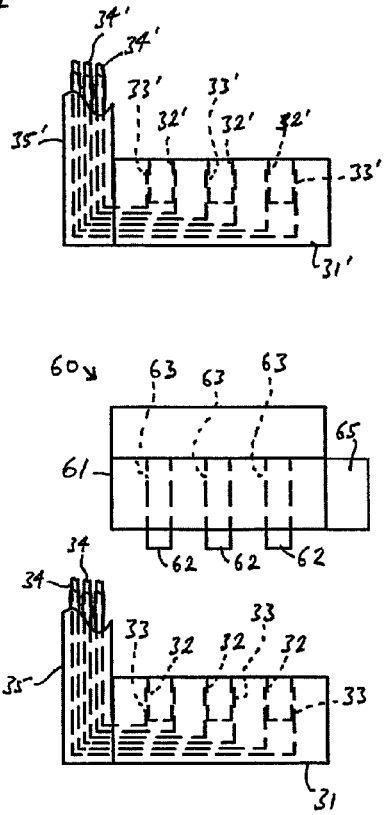
FIG. 2 shows the wet connector on the ESP just before engaging the lower wet connector on the tubing.

Referring also to FIG. 2, the production tubing includes a wet connection assembly 30 comprising first and second wet connectors 31, 31'. Each wet connector comprises at least one socket, and in the illustrated embodiment comprises a group of three sockets 32, 32', each socket containing a respective contact 33, 33'. The wet connectors are located in two respective windows 22, 22' in the tubular wall 23 of the production tubing, the windows being arranged one above the other, so that the wet connectors are spaced apart in the direction of the longitudinal axis X1-X1 of the tubing 20. The upper window 22' is somewhat narrower than the lower window 22 in the circumferential direction of the production tubing, which is to say, it subtends a smaller angle about the axis X1-X1. The respective groups of contacts 33, 33' of the two wet connectors are connected to the power supply 5 via the respective insulated conductors 34, 34' of two respective cables 35, 35' which are fixed by clamps (not shown) to the production tubing and extend sealingly through the packer 8 via the annulus 7 to the wellhead.

Each of the wet connectors may be of any suitable type as well known in the art. Whereas for convenience the wet connectors which are permanently installed in the production tubing are referred to hereinafter as "fixed" so as to distinguish them from the corresponding wet connector on the ESP, it should be understood that they may be moveable, for example, slideable, or extendible from a side pocket into the bore of the tubing so as to engage a static wet connector on the body of the ESP as known in the art, rather than immovably mounted with respect to the tubing wall as shown. In the illustrated embodiment each of the fixed wet connectors 31, 31' is of a conventional female type, each socket being lined with wiper seals, optionally containing a nonconductive fluid, and housing a spring loaded plunger which normally occupies the socket.

Referring also to FIGS. 3 and 4, the ESP 40 comprises an assembly of generally cylindrical modular parts 42, 45, 46, 48 and 49, which are connected together end to end in the direction of the longitudinal axis X3-X3 of the ESP by means of screwed flanges 41. In the example shown there is a single pump 42 with an inlet 43 and an outlet 44, the outlet being adapted to be releasably engaged by a retrieval and deployment tool 50 on a wireline 51. The pump is driven by a single, three phase electrical motor 45. (In practice, the ESP may be a much longer assembly including several such pump modules driven by a corresponding number of motor modules, all powered via the same wet connector.)

The lower end of the assembly comprises an orientation module 46 having a reduced external diameter, with an orientation element 47 extending radially outwardly from it to form an abutment at one point on its circumference. The assembly also includes a tubular spacer 48 (a hollow component without any functional internal parts) and a wet connection module 49, which carries the respective wet connection assembly 60 comprising a single wet connector 61 having an array of three contacts 62 comprising conductive male probes, each probe having a corresponding conductor 63.

Figure 3A:
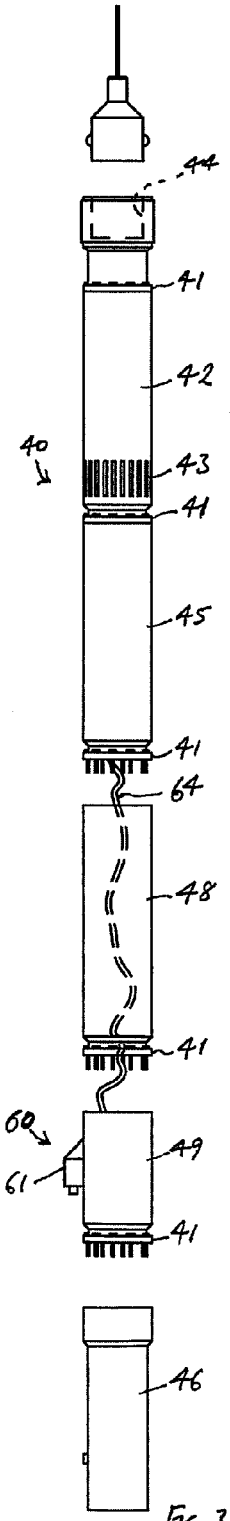
FIGS. 3A and 3B show the ESP, respectively before and after assembly in a first configuration.
Figure 3B:
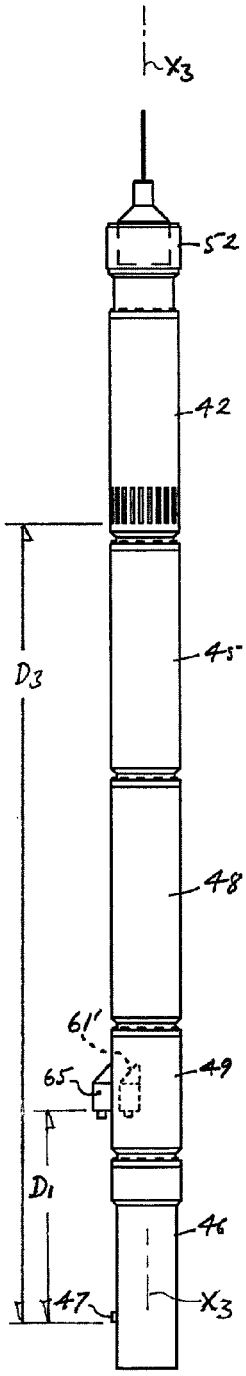

The wet connector 61 may be fixed immovably to the casing of the ESP (in which case the fixed connectors may be arranged to move radially inwardly into the wellbore to connect to it), but in the illustrated embodiment it is deployed in a retracted position 61' as shown in dotted lines in FIG. 3B and then released within the production tubing so that it extends radially outwardly to the extended position as shown. This may be accomplished in various ways as known in the art. For example, the wet connector 61 may be biased radially outwardly by a spring and restrained by contact with the inner surface 25 of the bore of the production tubing. Alternatively, the wet connector 61 can be restrained in the retracted position by a shear pin or other element and urged towards the extended position by the hydrostatic pressure exerted by fluid in the wellbore acting on one side of a piston with an evacuated chamber on the other. The shear pin or other element fails at a predetermined pressure corresponding to the approximate target depth, releasing the wet connector 61 which is then restrained by contact with the inner surface 25 of the production tubing as the ESP continues to travel down the well until it reaches the respective window 22 or 22'. A similar mechanism is taught by GB2478108 A.

Figure 4B:
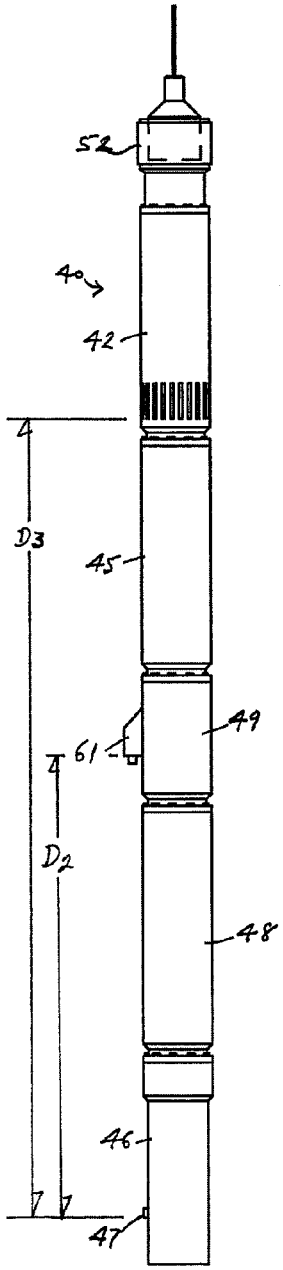
FIGS. 4A and 4B show the ESP, respectively before and after assembly in an alternative, second configuration.
Figure 4A:
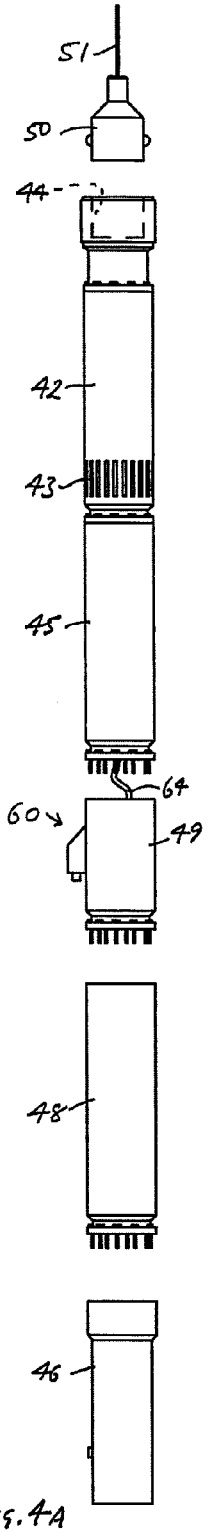

The ESP may be reconfigured by disassembling and selectively reassembling it in either the first configuration as shown in FIGS. 3A and 3B or the second configuration as shown in FIGS. 4A and 4B so as to space the wet connection assembly from the orientation element by a variable distance D1, D2 in the direction of the longitudinal axis X3-X3 of the ESP.

In the first configuration (FIGS. 3A, 3B) the spacer 48 is arranged between the wet connection module 49 and the motor 45 so that the wet connection module is connected directly to the orientation module. The conductors 63 of the wet connector are connected to the respective windings of the motor 45 via a cable 64 which passes through the tubular spacer 48; of course, suitable internal plugs and sockets could equally well be used. In this configuration, an extension block 65 is attached to the wet connector 61 so as to increase its width in the circumferential direction of the production tubing, which is to say, to increase the angle it subtends about the longitudinal axis X3-X3 of the ESP, so that it can fit within the wider, lower window 22 but not the narrower, upper window 22'.

In the second configuration (FIGS. 4A, 4B) the spacer 48 is removed and replaced in a position between the wet connection module 49 and the orientation module 46 so that the distance between the wet connector and the orientation element is reduced but the distance between the inlet and the orientation element remains the same. In this configuration the extension block 65 is also removed so that the wet connector 61 can fit within the narrower, upper window 22'.

Referring again to FIGS. 1A and 1B, the inner surface 25 of the bore 24 of the production tubing defines an orientation profile 26 just above its open lower end 21, comprising an upwardly facing partially elliptical ledge 27 (half of which can be seen in the drawings), the long axis X2-X2 of the ellipse being inclined with respect to the longitudinal axis X1-X1 of the tubing. The elliptical profile is downwardly elongated at its lowermost point to form a short vertical groove 28 between two opposed walls (one of which can be seen in the drawings) so that the orientation profile resembles an inverted teardrop.

Figure 5A:
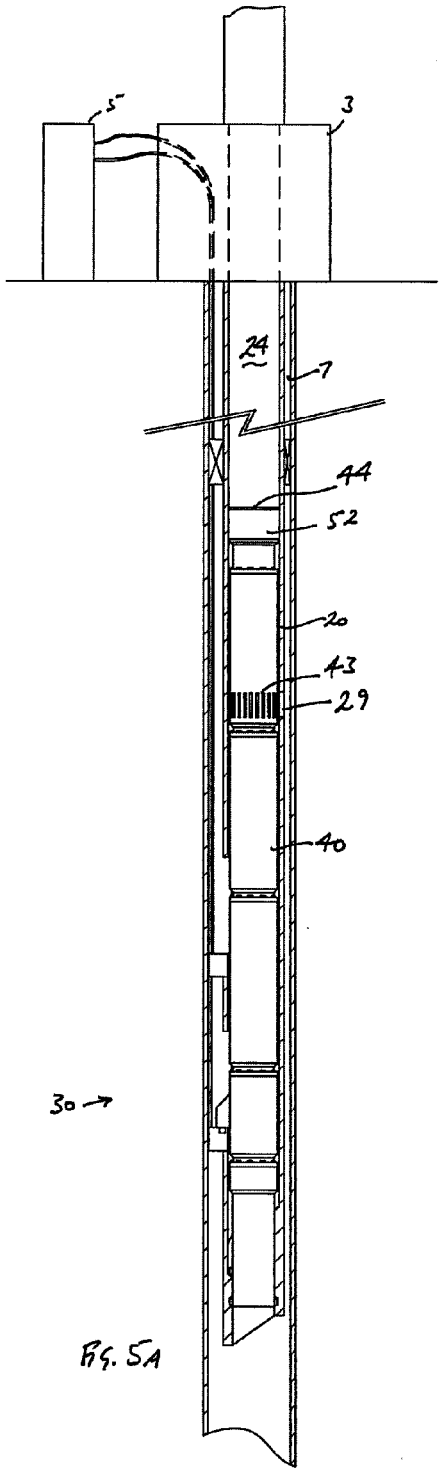
FIG. 5A shows the ESP deployed in the well in the first configuration.
Figure 5B:
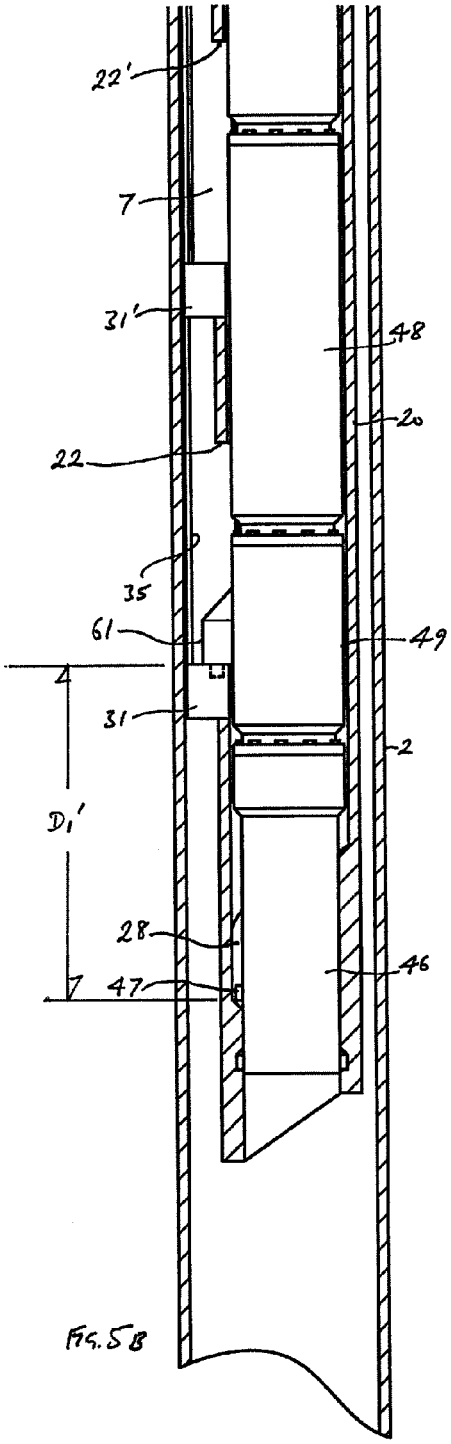
FIG. 5B is an enlarged view of part of FIG. 5A.
Figure 6A:
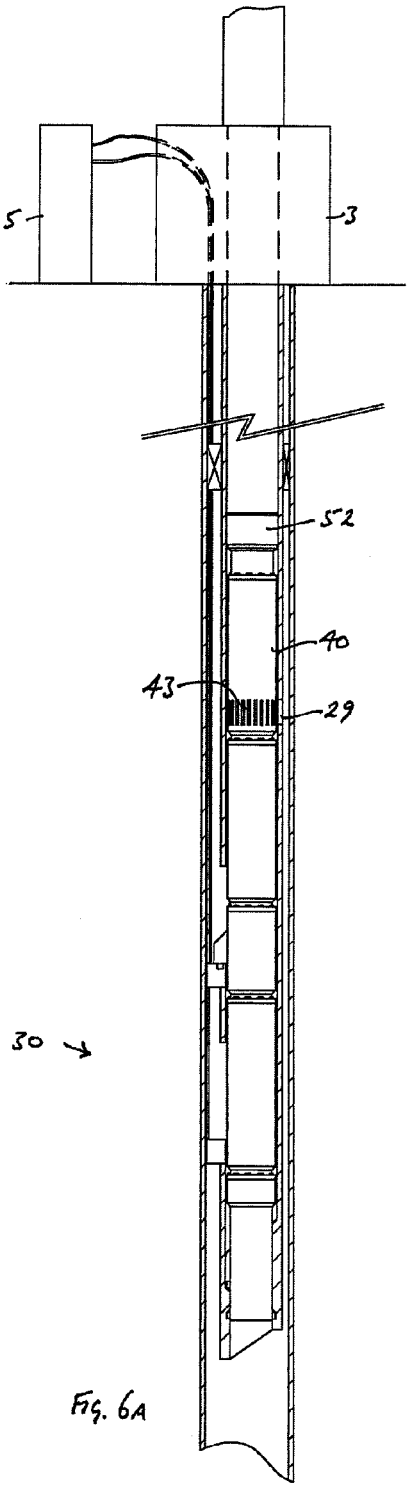
FIG. 6A shows the ESP deployed in the well in the second configuration.
Figure 6B:
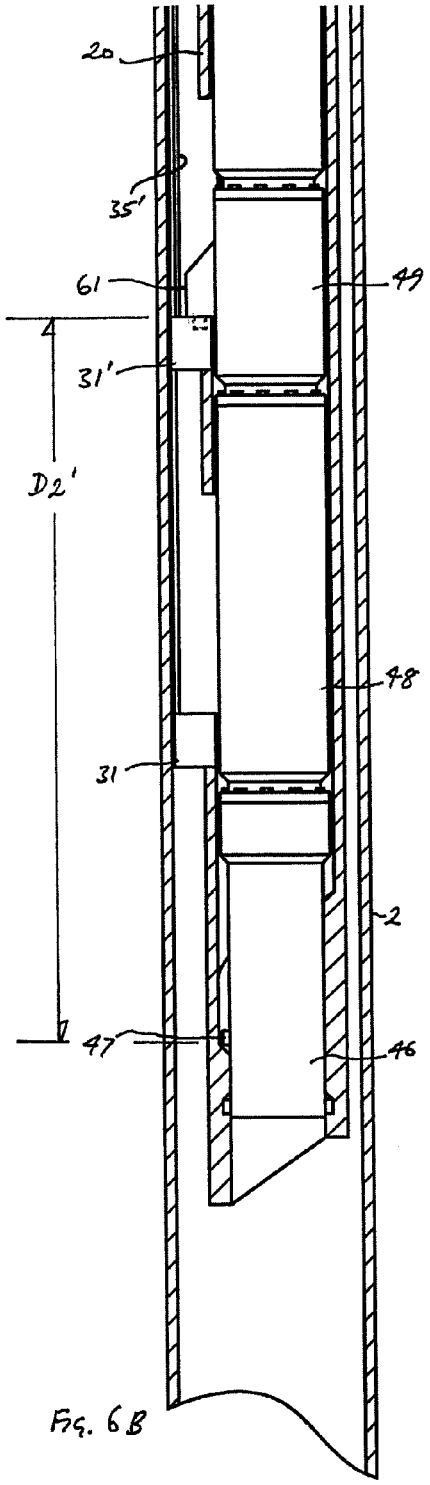
FIG. 6B is an enlarged view of part of FIG. 6A.

Referring to FIG. 2 and FIGS. 5A and 5B, the ESP is arranged in the first configuration and deployed via the wellhead 3 and lowered down the bore 24 of the production tubing on the wireline 51. The wet connector 61 is released at a predetermined depth and thereafter is restrained by sliding contact with the inner surface 25 of the production tubing as the ESP continues to travel down the well. The extension block 65 prevents the wet connector 61 from entering the upper window 22' so that the ESP continues to descend until the orientation element 47 engages the ledge 27 of the orientation profile and then travels slidingly along the ledge until it enters the vertical groove 28, orienting the ESP by rotating it into a position in which the wet connector 61 can move radially outwardly to enter the lower window 22 in alignment with the fixed wet connector 31 on the production tubing as shown in FIG. 2.

As the orientation element 47 travels down the groove 28 to the deployed position as shown in FIGS. 5A and 5B, each male probe of the wet connector 61 displaces the plunger in the corresponding socket 32 of the lower fixed wet connector 31 so that the contacts 62 engage the contacts 33, connecting the windings of the motor to the power supply via the respective conductors 34. It will be noted that in the first configuration of the ESP, the distance D1 between the wet connector 61 and the orientation element 47 thus corresponds to the distance D1' between the location of the orientation element 47 and the lower fixed wet connector 31 when the ESP is engaged with the orientation profile in the deployed position.

In the deployed position, the inlet 43 of the pump is arranged opposite the perforations 29 in the production tubing, and the ESP is sealed in the bore 24 by means of a packer 52 so that the produced fluid is drawn into the pump from the productive formation 6 via the annulus 7 below the packer 8 and through the perforations 29 and inlet 43 and expelled via the outlet 44 through the production tubing to the wellhead. Of course, in alternative embodiments the ESP and production tubing may be configured to produce fluid to surface via the annulus 7 above the packer 8 or in any other convenient way as known in the art.

The ESP is thus powered in the deployed position via the lower fixed wet connector 31 but not the upper fixed wet connector 31' which provides a redundant wet connection, so that the ESP can be powered in normal use alternatively from either of the fixed wet connectors. Of course, in alternative embodiments, more than two fixed wet connectors may be provided. In the illustrated embodiment, each of the fixed wet connectors is connected to surface via a separate cable 35, 35' so that the two redundant connections are entirely separate, although in alternative embodiments the two or more fixed wet connectors could be connected to different conductors in the same cable.

Referring to FIGS. 4A and 4B and FIGS. 6A and 6B, in the event of a failure in the lower fixed wet connector 31 or its cable 35, the retrieval tool 50 is coupled to the outlet 44 and the ESP is recovered to surface via the production tubing 20 and wellhead 3 on the wireline 51. As the ESP is raised from the deployed position the wet connector 61 is disconnected from the lower fixed wet connector 31 before its bevelled upper surface engages the upper edge of the window 22' causing it to retract into the body of the wet connection module 49.

The ESP is then disassembled at the surface and then reassembled in the second configuration before being redeployed on the wireline to the deployed position as shown, in which the wet connector 61 is re-connected to the upper fixed wet connector 31' so that the motor is powered normally from the power supply via the interengaged contacts 62, 33' and not the contacts 33 of the failed lower wet connector 31.

The extension block 65 is removed so that the wet connector 61 enters into the upper window 22' and engages the upper fixed wet connector 31' as the orientation element 47 travels down the orientation profile to rest in exactly the same deployed position as in the first configuration. It will be noted that in the second configuration, the distance D2 between the wet connector 61 and the orientation element 47 corresponds to the distance D2' between the location of the orientation element 47 and the upper fixed wet connector 31' when the ESP is engaged with the orientation profile in the deployed position as shown.

Advantageously, by rearranging the position of the tubular spacer, the distance D3 from the pump intake to the orientation element also remains the same in the second configuration as in the first configuration, as does the distance D4 from the pump outlet to the orientation element, so that the pump intake is arranged in the same position in the production tubing, and the same ESP can readily be redeployed without requiring any further adaptations and without affecting the flow of produced well fluid, irrespective of the particular flow configuration employed in the well.

In summary, in a preferred embodiment a wet connection system comprises a fixed tubing with an orientation profile and redundant, first and second fixed wet connectors, and an ESP comprising a wet connector and an orientation element for engaging the orientation profile. The ESP can be reconfigured, for example, by interchanging its component modules so as to change the position of its wet connector with respect to the orientation element, whereby the wet connector on the ESP can be engaged alternatively with either one of the fixed wet connectors when the orientation element is engaged with the orientation profile in the same deployed position of the ESP.

Of course, in alternative embodiments, more than two redundant fixed wet connectors may be provided.

Instead of a tubular spacer, one or more functional modules such as a motor protector, a motor or a pump could be selectively arranged in the same position between the wet connection module and the orientation module and removed or rearranged to reconfigure the ESP as described above. Alternatively, the tubular spacer or other selected components could be interchanged with other components of different dimensions. The parts of the ESP could also be selectively reassembled by omitting some parts and inserting other parts into the assembly so as to achieve the second configuration.

In alternative embodiments, the tubing comprising the orientation profile need not necessarily be production tubing; it could be for example the well casing or any other tubing installed in the borehole. The orientation profile could be a ledge, groove or any other feature of helical or any other convenient shape as known in the art.

In the illustrated embodiment the first and second fixed wet connectors 31, 31' are spaced apart in the direction of the longitudinal axis X1-X1 of the production tubing. In alternative embodiments they may be spaced apart alternatively or additionally in angular relation, i.e. rotationally about the axis X1-X1, in which case the ESP may be reconfigured by separating the respective modules and rotating the wet connector to the required angular position with respect to the orientation element before reassembly. Each wet connection assembly could also comprise more than one wet connector, each wet connector comprising an insulated body with one or more contacts. Of course, instead of the arrangement shown, in alternative embodiments the fixed wet connectors could equally well be male and that on the ESP female.

In alternative embodiments, rather than reassembling the cylindrical parts of the ESP, two alternative mounting positions could be provided for the wet connector so that it could be detached and re-attached in a different position on the outer casing.

In the illustrated embodiment, the wet connection assembly on the ESP comprises a single wet connector which is engaged in the deployed position, in the first configuration with the at least one first (lower) contact 33 but not the at least one second (upper) contact 33' of the fixed assembly, and in the second configuration with the at least one second (upper) contact 33' but not the at least one first (lower) contact 33 of the fixed assembly.

In alternative embodiments the wet connection assembly on the ESP could include a first wet connector and a second wet connector disposed in spaced relation to the first wet connector, in which case the first and second wet connectors could be connected simultaneously, respectively to the first and second contacts of the fixed assembly.

In this case the ESP may be selectively configurable by means of an internal switch for selectively connecting the motor to either the first or the second wet connector on the ESP, the switch being operable for example by the presence of a voltage at the second contact of the fixed assembly to disconnect the motor from the first wet connector and reconnect it to the second.

Alternatively for example, the switch could be mechanically operable, for example, by means of a bistable mechanism operating in a conventional way (for example, as generally known in pull-cord light switches). The mechanism could be triggered for example by slidably mounting the orientation element (or another separate abutment element) in the casing of the ESP so that each time the ESP descends to bring the respective element into contact with the orientation profile or some other abutment surface of the tubing, the respective element is moved slidingly upwards to toggle the bistable mechanism between a first position (in which the motor is connected to the first wet connector and disconnected from the second) and a second position in which the connections are reversed. Of course, a bistable electronic switching arrangement could be used instead to toggle the connection between the motor and the two respective wet connectors, and could be operated for example by a signal generated by a sensor each time the ESP passes by a magnet or the like in the tubing.

Alternatively, the ESP could comprise first and second wet connectors which are alternatively and individually connected, respectively to the first and second contacts, for example, by suitable control means for extending them selectively one at a time from a deployed position to a radially outwardly extended position. The control means could be electrically or hydraulically actuated via a suitable conductor in the wireline on which the ESP is deployed. Alternatively it could be mechanical, for example, employing a bistable mechanism of the type mentioned above, whereby the first and second wet connectors are alternatively and respectively restrained or retracted and released or extended. Each connector may be extended or retracted by stored spring force, hydraulic force, an electrically powered solenoid, motor or other element, or by abutment with a sloping internal surface of the tubing as the ESP is raised or lowered, as well known in the art. Again, a nonmechanical sensor could be used to trigger the deployment mechanism so as to restrain one wet connector in the retracted position and extend the other.

Those skilled in the art will readily conceive many further adaptations within the scope of the claims.

The invention claimed is:

1. An apparatus for use in a well, the well including a wellhead and a power supply at the wellhead, the apparatus comprising:

a tubing disposed in the well, the tubing including an orientation profile;

at least one first wet connect contact and at least one second wet connect contact, the first and second contacts arranged fixedly to the tubing and connected by at least one cable to the power supply, the first and second contacts spaced apart in a longitudinal direction of the tubing;

and an electrical submersible pump assembly (ESP), the ESP including at least one pump, at least one electrical motor for driving the pump, a corresponding ESP wet connection part, and an orientation element;

the ESP being deployable and recoverable via the tubing and wellhead to and from a deployed position in which the ESP is oriented by engagement of the orientation element with the orientation profile;

wherein the ESP is selectively configurable in a first configuration in which in the deployed position the at least one motor is connected to the power supply via the at least one first contact but not the at least one second contact, and a second, alternative configuration in which in the deployed position the at least one motor is connected to the power supply via the at least one second contact but not the at least one first contact, and such that ESP may be powered in normal use in either one of the first and second configurations.

2. An apparatus according to claim 1, wherein in the first configuration the ESP is engaged in the deployed position with the at least one first contact but not the at least one second contact, and in the second configuration the corresponding ESP connection is engaged in the deployed position with the at least one second contact but not the at least one first contact.

3. An apparatus according to claim 2, wherein the ESP comprises parts which may be disassembled and selectively reassembled in either the first or the second configuration.

4. An apparatus according to claim 3, wherein the ESP is reconfigurable to space the corresponding ESP connection part from the orientation element by a variable distance in a longitudinal axial direction of the ESP.

5. An apparatus according to claim 4, wherein the said parts are connected together end to end in the longitudinal axial direction of the ESP, and the ESP is reconfigurable by inserting or removing one said part into or from a position between the corresponding ESP connection part and the orientation element.

6. An apparatus according to claim 5, wherein a distance between an inlet or outlet of the pump and the orientation element is the same in both the first and second configurations.

7. A method of connecting an electrical submersible pump assembly (ESP) to a power supply in a well;

the well including a wellhead, a tubing disposed in the well and including an orientation profile, and a first wet connection assembly comprising at least one first contact and at least one second contact, the first and second contacts being arranged in spaced relation and connected by at least one cable to the power supply;

the ESP including at least one pump, at least one electrical motor for driving the pump, a corresponding ESP wet connection part, and an orientation element;

the method comprising:

deploying the ESP down the tubing via the wellhead;

engaging the orientation element with the orientation profile so as to orient the ESP, and then powering the at least one motor in the deployed position from the power supply via the at least one first contact but not the at least one second contact; and then reconfiguring the ESP to power the at least one motor in the deployed position from the power supply via the at least one second contact but not the at least one first contact, wherein reconfiguring the ESP comprises spacing the corresponding ESP wet connection part away from the orientation element in a longitudinal axial direction of the tubing.

8. A method according to claim 7, wherein reconfiguring the ESP includes disconnecting the corresponding ESP wet connection part from the at least one first contact and reconnecting it to the at least one second contact but not to the at least one first contact.

9. A method according to claim 7, wherein reconfiguring the ESP includes recovering the ESP from the deployed position via the tubing and the wellhead, disassembling the ESP, repositioning the corresponding ESP connection part with respect to the orientation element, reassembling the ESP and redeploying it via the wellhead and tubing to the deployed position.

10. A method according to claim 9, wherein repositioning the corresponding ESP connection part with respect to the orientation element includes inserting or removing a part of the ESP into or from a position between the second wet connection assembly and the orientation element in a longitudinal axial direction of the ESP.

* * * * *